US007650661B2

(12) United States Patent
Young

(10) Patent No.: US 7,650,661 B2
(45) Date of Patent: Jan. 26, 2010

(54) MOPHEAD

(76) Inventor: Ronald Alexander Young, 95 Mushroom Green, Dudley Wood, West Midlands (GB) DY2 0EE ( * ) Notice: Subject to any disclaimer, the term of this patent is extended or adjusted under 35 U.S.C. 154(b) by 626 days.

(21) Appl. No.: 11/362,108

(22) Filed: Feb. 27, 2006

(65) Prior Publication Data

US 2006/0195997 A1 Sep. 7, 2006

(30) Foreign Application Priority Data

Mar. 1, 2005 (GB) ..... 0504122.3
May 20, 2005 (GB) ..... 0510320.5

(51) Int. Cl.
*A47L 13/12* (2006.01)
*A47L 13/24* (2006.01)

(52) U.S. Cl. ..... 15/118; 15/147.1; 15/150; 15/228; 15/229.2

(58) Field of Classification Search ..... 15/115, 15/118, 147.1, 147.2, 150–153, 228, 229.1, 15/229.2, 229.6
See application file for complete search history.

(56) References Cited

U.S. PATENT DOCUMENTS 399,223 A * 3/1889 Varney ..... 15/115
684,155 A * 10/1901 Wilburn ..... 15/150
701,657 A * 6/1902 Wilson ..... 15/115
732,744 A 7/1903 Held
1,827,578 A * 10/1931 Harder ..... 15/228
1,840,189 A * 1/1932 Dwork ..... 15/115
2,133,148 A * 10/1938 Paul ..... 15/115
2,683,886 A * 7/1954 Neumann ..... 15/115
5,584,091 A 12/1996 Borofsky
6,178,581 B1 1/2001 Lewis
6,836,921 B1 1/2005 Petner
2004/0187240 A1 9/2004 Berti et al.

FOREIGN PATENT DOCUMENTS

JP 2000-254060 * 9/2000
WO 00/42894 7/2000
WO WO 00/42894 7/2000

* cited by examiner

*Primary Examiner*—Mark Spisich
(74) *Attorney, Agent, or Firm*—Young & Thompson

(57) ABSTRACT

A mophead includes a holder having an attachment location for attaching flexible absorbent mop material to the holder, and an attachment member which is spaced from the mop material attachment location and which can directly engage a scrub element with the holder independently of the mop material. The attachment member is a, preferably elongate bar, clamp which, in use, presses the scrub element directly to the mophead to clamp it thereto.

14 Claims, 4 Drawing Sheets

MOPHEAD

BACKGROUND OF THE INVENTION

This invention relates to a mophead for mops which are used, primarily, for wet mopping of floors. In particular, but not exclusively, this invention relates to a mophead in combination with scrub element.

Mops comprise a mophead attachable or attached to a handle. The mophead generally has a holder to which flexible absorbent mop material is attached or attachable. It is known from GB2323024 to provide such a mophead where the mop material is in the form of strands and a brush or like cleaning implement is positioned amongst the strands. Such an arrangement is beneficial due to the ease by which the brush can contact the surface being cleaned. However, a problem becomes apparent in that the mop strands interfere with the brush. This results in the brush not only being unable to easily contact the cleaning surface uniformly, but also damage to the strands.

A further problem presents itself in that other types of mop material, such as a sponge and/or sheet or sheets of absorbent material, cannot readily be used.

The present invention therefore seeks to provide a solution to these problems.

SUMMARY OF THE INVENTION

According to a first aspect of the present invention, there is provided a mophead comprising a holder having an attachment location for attaching flexible absorbent mop material to the holder, and an attachment member which is spaced from the mop material attachment location of the holder and which can directly engage a scrub element with the holder independently of the mop material, wherein the attachment member comprises a clamp which, in use, presses the scrub element directly to the mophead to clamp it thereto.

According to a second aspect of the present invention, there is provided a mophead, according to the first aspect of the invention, in combination with absorbent mop material, the mop material being a bundle of flexible strands, sponge material or one or more sheets of flexible absorbent material.

According to a third aspect of the present invention, there is provided a mophead, according to the first aspect of the invention, in combination with a scrub element which is directly engaged with the holder by the attachment member.

According to a forth aspect of the invention, there is provided a scrub element for use with a mophead, according to the first aspect of the invention, the scrub element having a protective backing which, in use, protects adjacent mop material from abrasion.

The invention will now be more particularly described, by way of example only, with reference to the accompanying drawings.

DESCRIPTION OF THE PREFERRED EMBODIMENTS

Figure 5:
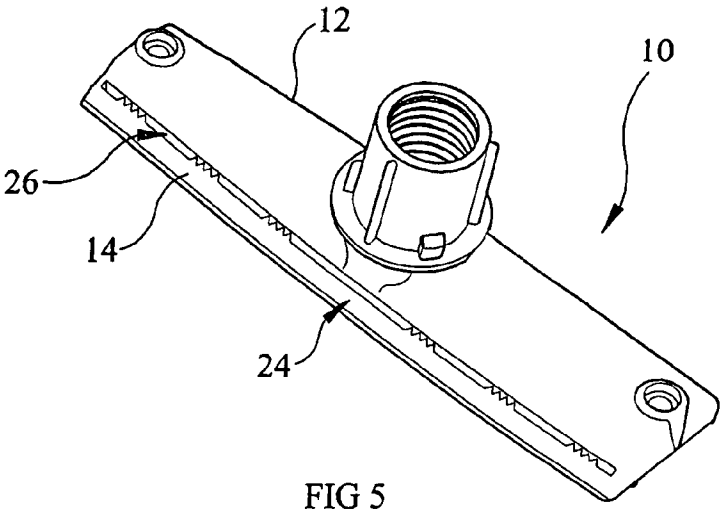
FIG. 5 is a perspective view of the mophead shown in FIG. 1.
Figure 3:
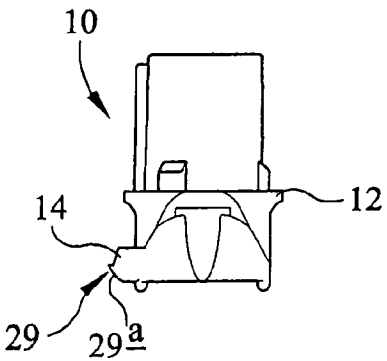
FIG. 3 is an end view of the mophead.
Figure 4:
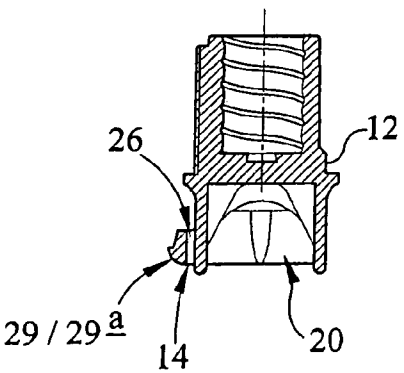
FIG. 4 is a transverse sectional view taken along the line A-A in FIG. 2.
Figure 1:
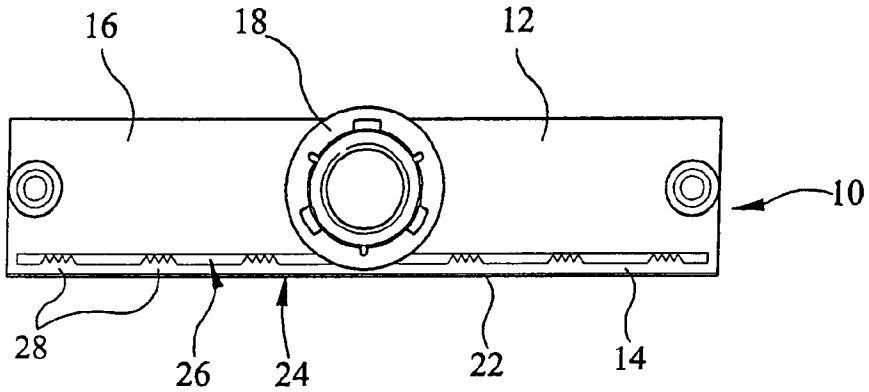
FIG. 1 is a top plan view of a first embodiment of a mophead, in accordance with the first aspect of the invention.
Figure 2:
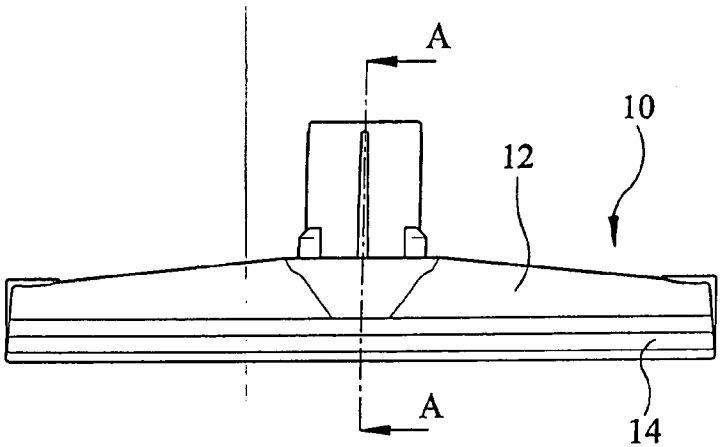
FIG. 2 is a side view of the mophead shown in FIG. 1.

Referring firstly to FIGS. 1 to 7, there is shown a first embodiment of a mophead 10 which comprises a holder 12 and an attachment member 14 for directly attaching scrub element 15 to the holder 12.

The holder 12 is, typically, formed from moulded plastics, and includes an elongate body part 16 and a tubular portion 18 integrally formed centrally or substantially centrally on the body part 16. The tubular portion 18 defines a socket or boss for receiving a mop handle (not shown) to form a complete mop.

The body part 16 of the holder 12 defines a generally inverted U-shaped channel 20 (see FIG. 4), and forms an attachment location for attaching flexible absorbent mop material (not shown).

The mop material can be, for example, a bundle of flexible strands, a pad or block of sponge, or a sheet or sheets of flexible absorbent material. The holder 12 shown in the drawings is intended to include an elongate releasable clamping member to releasably clamp the mop material in the channel 20 of the body part 16 of the holder 12. Although not shown in the drawings, the clamping member may take the form suggested in GB2323024 without the brush or other cleaning device. As such, the body part 16 of the holder 12 is adapted to accept releasable engagement of the clamping member.

In an alternative, the holder 12 may be formed in a manner which is intended to permanently attach the mop material in the channel 20 of the holder 12.

The attachment member 14 is unitarily formed, typically by moulding, as part of the holder. The attachment member 14 is provided at or adjacent to an outside edge 22 of the holder 12, and is thus spaced from the channel 20.

The attachment member 14 is in the form of an elongate bar or clamp 24, and defines a through-slot 26. A plurality of teeth 28 are formed along the clamp 24. Each tooth projects into the slot 26 and towards the holder 12.

The attachment member 14 also includes an angled or chamfered lower outer edge 29. This edge 29 is adapted to present a flat face 29*a* which is angled relative to the axis of the socket or boss 18.

Figure 6:
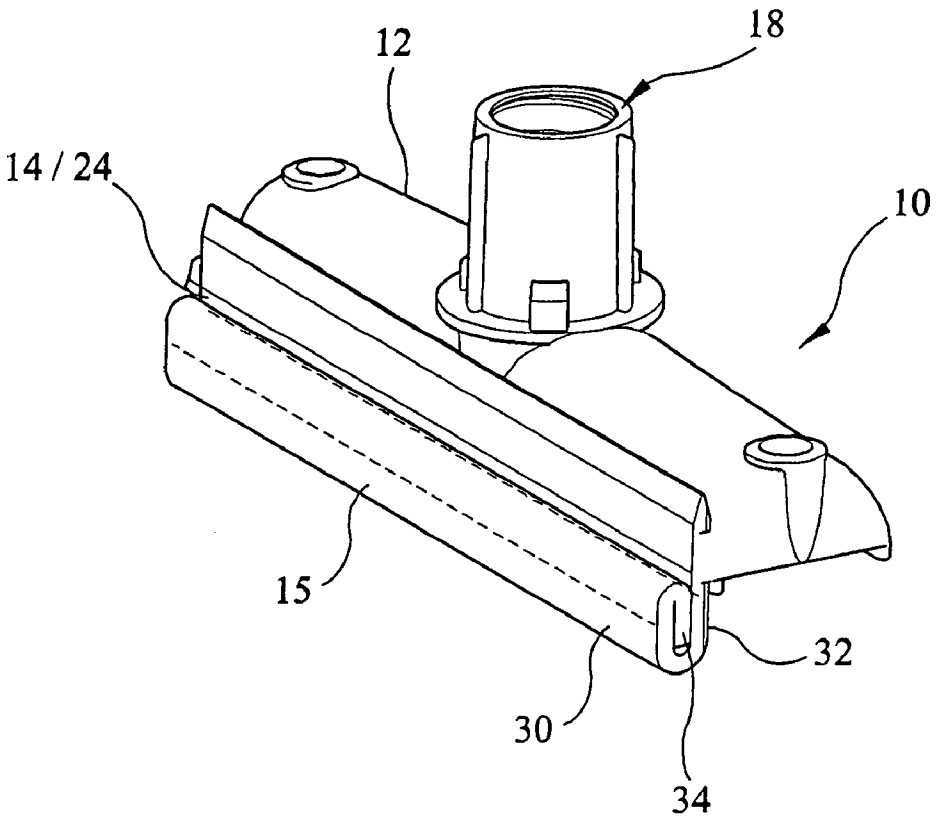
FIG. 6 is a perspective view of the mophead with scrub element, in accordance with the third aspect of the invention.
Figure 7:
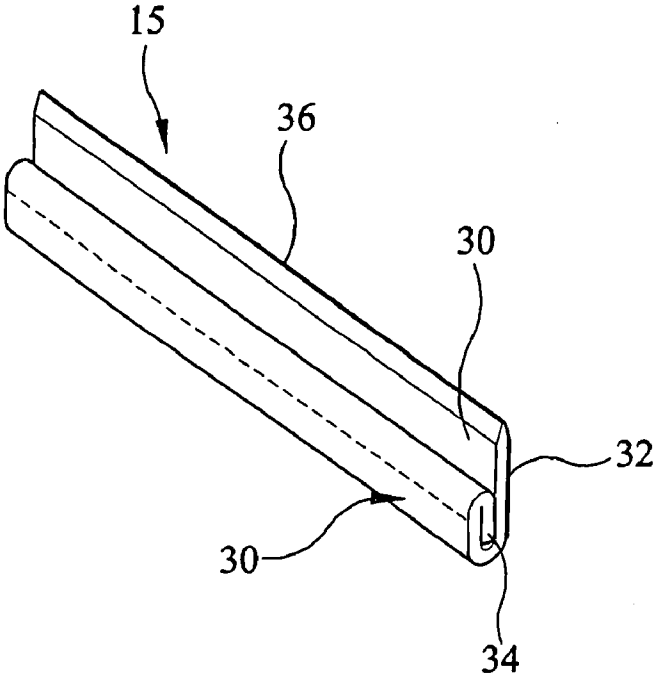
FIG. 7 is a perspective view of the scrub element, in accordance with the fourth aspect of the invention.

Referring to FIGS. 6 and 7, the scrub element 15 can be seen. The scrub element comprises a layer 30 of abrasive material, and a protective backing layer 32, preferably but not necessarily integrally formed, on one side of the abrasive layer 30. In the embodiment shown, the scrub element 15 has a reentrant longitudinal edge 34 which stiffens the scrub element 15 for use. However, the scrub element may just be a planar or substantially planar sheet.

Although not essential, the edge 36 of the scrub element 15 opposite the reentrant edge 34 is tapered to a point and reinforced to simplify insertion into the slot 26 defined by the attachment member 14. Reinforcement is realised by simply heating and compressing the edge 36 of the scrub element 15 to form the point.

In use, and with mop material attached to the holder 12 at the attachment location, the tapered edge 36 of the scrub element 15, with the abrasive layer facing outwards, is pushed into and through the slot 26. The scrub element 15 is thus releasably clamped directly to the holder 12, independently of the mop material, by the attachment member 14 extending across the exterior of the scrub element 15. The teeth 28 grip the scrub element 15 when positioned in the slot 26 to prevent or limit undesirable movement.

With the scrub element 15 projecting downwardly adjacent to an outer surface of the mop material, the protective backing layer 32 of the scrub element 15 faces the mop material and the mop material is thus protected from abrasion or damage caused by the abrasive layer 30 of the scrub element 15.

To replace the scrub element 15, it is simply pulled from the slot 26. A new or cleaned scrub element 15 can then be re-inserted and clamped by the attachment member 14.

Figure 8:
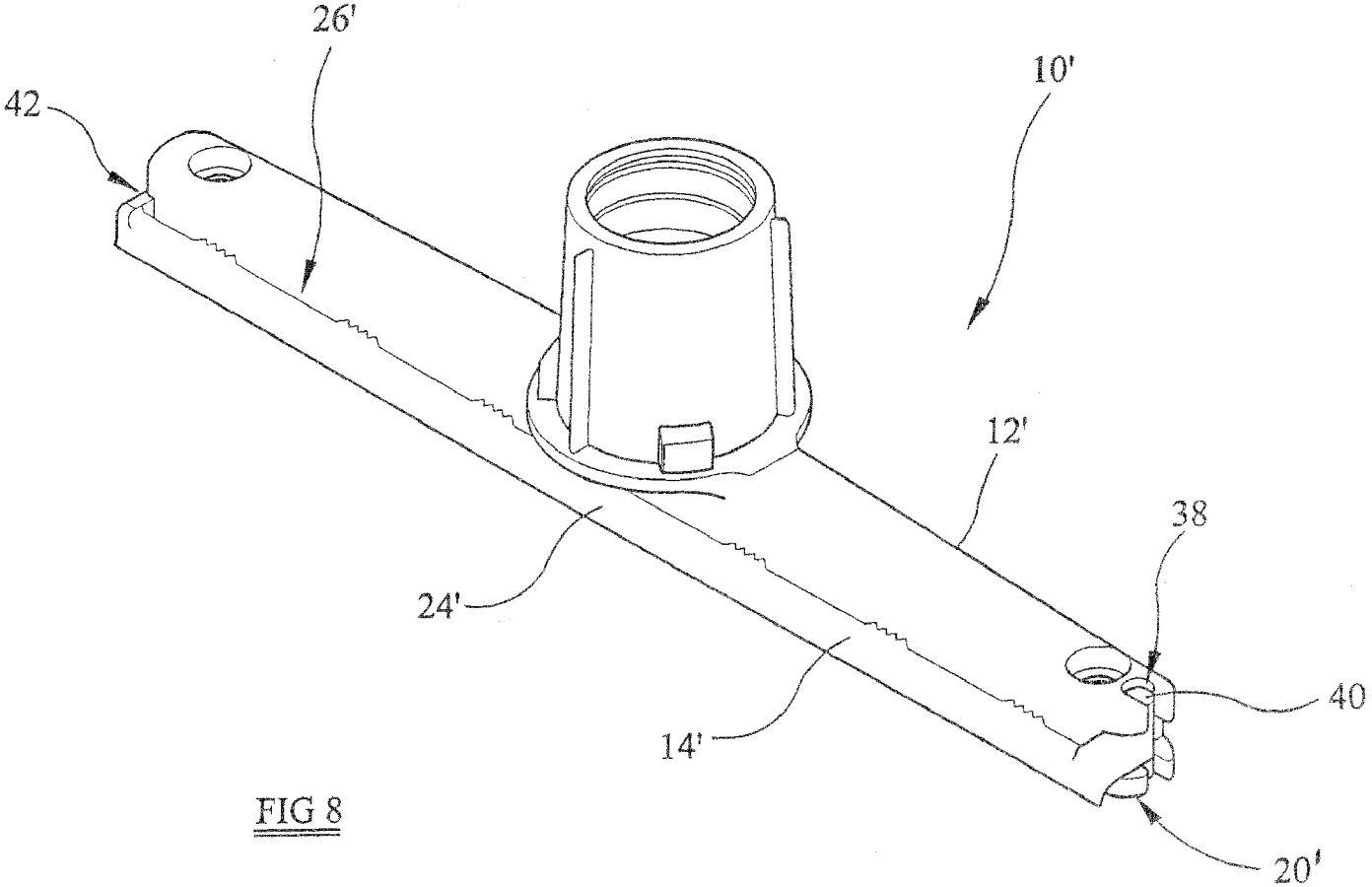
FIG. 8 is a perspective view of a second embodiment of a mophead, in accordance with the first aspect of the invention.
Figure 9:
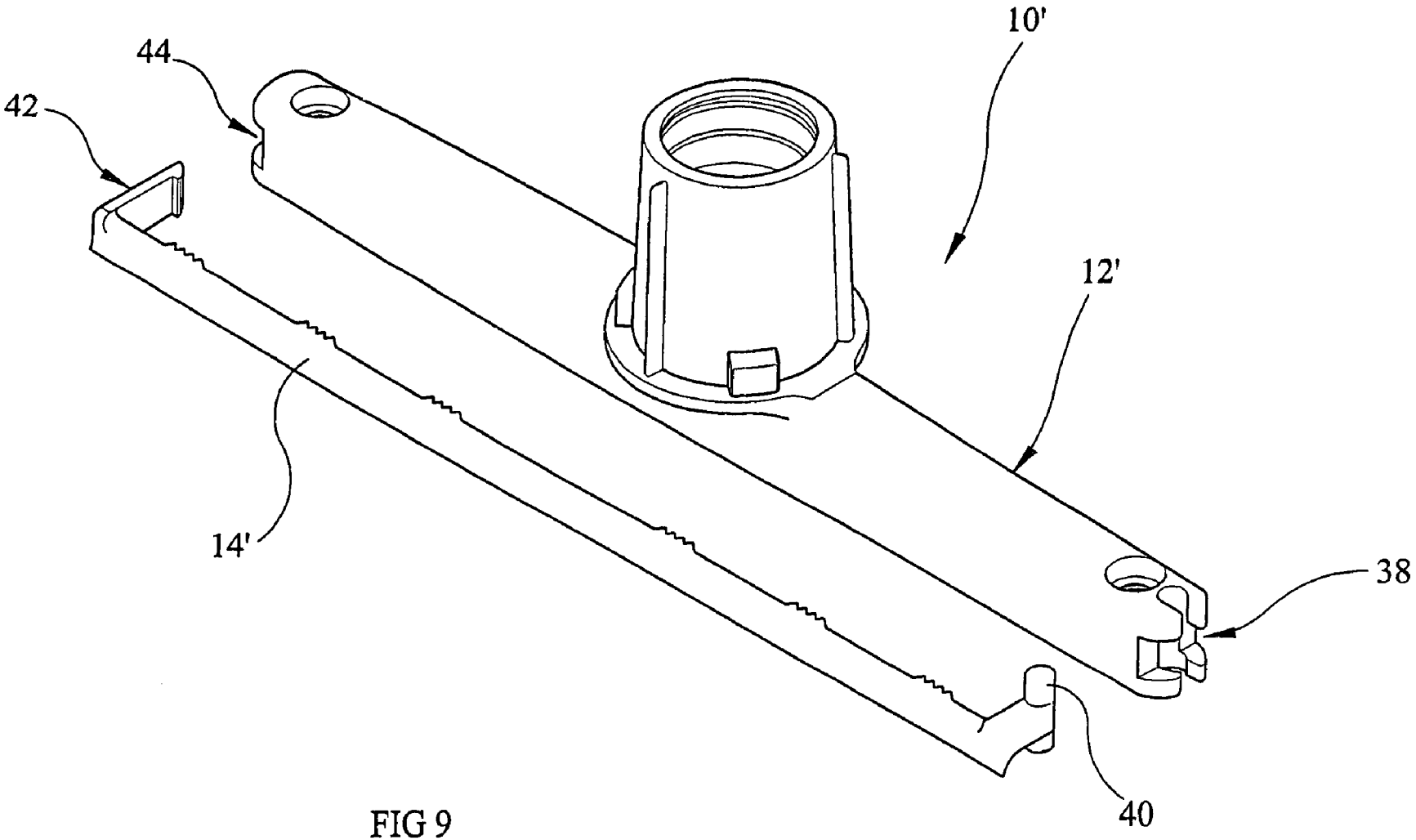
FIG. 9 is an exploded view of the mophead of the second embodiment.

Referring now to FIGS. 8 and 9, there is shown a second embodiment of a mophead 10'. Similar references refer to similar parts, and further detailed description will thus be omitted.

Mophead 10' comprises holder 12' and attachment member 14' for directly attaching a scrub element as shown, by way of example, in FIG. 7.

The holder 12' again includes a channel 20' for independent location and attachment of mop material.

The attachment member 14' is, similarly to the first embodiment, an elongate bar or clamp 24'. However, in this case, the attachment member 14' is removably engagable with the holder 12'.

The holder 12' includes a hinge socket 38, which is complementarily shaped to receive a hinge element 40 formed on one end of the attachment member 14'. The hinge socket 38 and hinge element 40 are separable.

The attachment member 14' also includes a catch element 42 formed on the other end. The catch element 42 is cooperable with a retaining portion 44 integrally formed at or adjacent to an end of the holder 12' opposite the hinge socket 38.

In use, the attachment member 14' can be optionally released via the catch element 42, and pivoted away from the holder 12', to allow removal and/or insertion of a scrub element. The attachment member 14' can even be completely removed from the holder 12'.

Alternatively, the catch element 42 of the attachment member 14' can remain engaged with the retaining portion 44 of the holder 12', thereby defining through-slot 26'. A scrub element can therefore be inserted and removed as described with reference to the first embodiment.

In a modification to the second embodiment, the hinge socket 38 and hinge element 40 can be replaced with a further catch element and retaining portion, similar to those referenced as 42 and 44. The attachment member can thus be unfastened and removed to aid insertion and removal of a scrub element.

The scrub element, as shown by way of example in FIG. 7, can also be used when inverted and reversed. In this arrangement, the protective backing layer 32 faces outwards, and the reentrant edge 34 is positioned adjacent to the spigot or boss 18. Preferably, the tapered edge 36 is dispensed with.

In this configuration, the planar portion (generally referenced at 30) of the scrub element 15 bends outwardly away from the holder 12 when contacting a surface to be cleaned. When bent, the protective backing layer 32 contacts the flat face 29*a* of the attachment member 14, resulting in a greater portion of the abrasive face of the scrub element 15 being more forcibly urged into contact with the surface to be cleaned when the holder is angled.

The protective backing 32 may extend fully over one side of the scrub element 15, or only over a portion thereof To aid insertion of the scrub element 15 into the slot 26, a smooth flexible slip or sheath can be provided which covers at least part of the scrub element 15 the scrub element 15 can thus be smoothly fed into the slot 26, and once positioned, the slip or sheath can be extracted and disposed of, leaving the scrub element being gripped by teeth 28.

The mophead 10/10' is typically used with a cleaning liquid container, such as a domestic or commercial bucket or pail, which may or may not have a mop wringer. The mop wringer may be mechanical or manual.

The holder 12/12' can be dimensioned to fit, and is thus useable with, any suitable mop wringer.

The scrub element is not, and does not include, a bundle of mop strands. The protective backing may be independent of the abrasive scrubbing material, or may be only partly attached.

It is thus possible to provide a mophead having provision for a scrub element which does not interfere with, and is not impeded by, mop material held by the mophead. It is also possible to provide a mophead which has a scrub element which does not damage the mop material, and which uniformly contacts the surface to be cleaned. It is further possible to provide an independent scrub element which is directly clampable to a holder of a mophead and which can be swapped or replaced as necessity dictates.

The embodiments described above are given by way of examples only, and various other modifications will be apparent to persons skilled in the art without departing from the scope of the invention, as defined by the appended claims.

What is claimed is:

1. A mophead comprising:

a holder including (a) a body part that defines an elongated and inverted generally U-shaped channel which provides therein an attachment location for attaching flexible absorbent mop material to the holder, and (b) a socket for receiving a mop handle; and an attachment member which is spaced from the mop material attachment location of the holder and which in use directly engages a scrub element, which is a pad of abrasive material, with the body part of the holder, independently of the mop material, to clamp the scrub element to a limb of the body part.

2. A mophead as claimed in claim 1, wherein the attachment member is unitarily formed as part of the holder.

3. A mophead as claimed in claim 1, wherein the attachment member is releasably attachable to the holder.

4. A mophead as claimed in claim 1, wherein the attachment member is positioned or positionable at or adjacent to an outside edge of the holder.

5. A mophead as claimed in claim 1, wherein the attachment member is an elongate bar.

6. A mophead as claimed in claim 1, wherein the attachment member includes one or more teeth for directly gripping the scrub element.

7. A mophead as claimed in claim 1, wherein the attachment member includes an angled or chamfered edge for pressing the scrub element into contact with a surface to be cleaned.

8. A mophead as claimed in claim 1, in combination with absorbent mop material, the mop material being a bundle of flexible strands, sponge material or one or more sheets of flexible absorbent material.

9. A mophead as claimed in claim 8, wherein the mop material is permanently attached or releasably attachable to the holder at the attachment location.

10. A mophead as claimed in claim 1, wherein the scrub element is releasably engaged with the holder.

11. A mophead as claimed in claim 1, wherein the scrub element projects downwardly from the holder.

12. A mophead as claimed in claim 1, wherein the scrub element is engageable with the holder in two different orientations so as to perform two different kinds of scrubbing.

13. A mophead as claimed in claim 12, wherein the scrub element is engageable with the holder in a first position to perform a first kind of scrubbing, and is engageable with the holder in a second position, which is inverted and reversed relative to the first position, to perform a second kind of scrubbing.

14. A mophead as claimed in claim 1, wherein the channel and attachment member extend longitudinally along the holder generally the same distance.

* * * * *

UNITED STATES PATENT AND TRADEMARK OFFICE

CERTIFICATE OF CORRECTION

PATENT NO. : 7,650,661 B2
APPLICATION NO. : 11/362108
DATED : January 26, 2010
INVENTOR(S) : Ronald Alexander Young It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 959 days.

Signed and Sealed this

Twenty-eighth Day of December, 2010

David J. Kappos

David J. Kappos
*Director of the United States Patent and Trademark Office*